United States Patent [19]

Maroszek

[11] Patent Number: 4,819,862

[45] Date of Patent: Apr. 11, 1989

[54] DISPOSABLE PLATE LID AND FOOD CONTAINER INCLUDING SAME

[75] Inventor: Raymond V. Maroszek, Neenah, Wis.

[73] Assignee: James River-Norwalk, Inc., Norwalk, Conn.

[21] Appl. No.: 859,660

[22] Filed: May 5, 1986

[51] Int. Cl.[4] ..... B65D 43/06

[52] U.S. Cl. ..... 229/125.27; 220/305; 229/41 R; 229/125.29; 229/906

[58] Field of Search ..... 229/43, 45 R, 2.5 R, 229/113, 23 BT, 162, 169, 170, 906, 41 R, 41 B, 23 R, 125.27, 125.29; 206/45.32, 45.34; 220/305, 306; 312/284

[56] References Cited

U.S. PATENT DOCUMENTS

| | | | |
|---|---|---|---|
| 1,485,584 | 3/1924 | Bergstein | 229/41 B |
| 2,284,959 | 6/1942 | Guyer et al. | 229/23 R |
| 3,027,062 | 3/1962 | Huss et al. | 229/114 |
| 3,176,900 | 4/1965 | Ciganenko | 229/43 |
| 3,276,662 | 10/1966 | Farquhar | 229/41 B |
| 3,716,164 | 2/1973 | Fennema | 220/306 |
| 3,795,360 | 3/1974 | Bianchi et al. | 220/306 |
| 3,955,710 | 5/1976 | Commisso | 229/2.5 R |
| 4,516,718 | 5/1985 | Forbes, Jr. | 229/45 R |

FOREIGN PATENT DOCUMENTS

| | | | |
|---|---|---|---|
| 641292 | 6/1962 | Italy | 229/45 R |
| 700311 | 1/1966 | Italy | 229/45 R |
| 20859 | 12/1910 | Norway | 229/41 R |

*Primary Examiner*—Stephen Marcus
*Assistant Examiner*—Gary E. Elkins
*Attorney, Agent, or Firm*—Cooper & Dunham

[57] ABSTRACT

A foldable, resilient plate lid of paperboard or the like, having a central panel surrounded by four side panels glued together at overlapping end flap portions to form a continuous skirt which, when open, flares obliquely downwardly from the central panel to encompass the rim of a disposable plate. Opposed rim-receiving slots are formed in at least tow of the side panels. Initially, for gluing, the latter two side panels are folded inwardly under the central panel while the other two panels remain unfolded except for their end flaps, so that upon subsequent opening of the skirt to cover a plate, resilient bias forces urge the initially folded side panels into secure engagement with the rim.

1 Claim, 3 Drawing Sheets

DISPOSABLE PLATE LID AND FOOD CONTAINER INCLUDING SAME

BACKGROUND OF THE INVENTION

This invention relates to disposable plate lids, and to food containers of the type comprising a disposable plate and a disposable lid therefor.

Many commercial and institutional establishments, such as fast food restaurants and school cafeterias, in which food is sold and/or served on disposable plates of paperboard, foam plastic or the like, utilize disposable lids or covers for the plates. The lids and plates cooperatively constitute protective containers for the food, and after removal of the lids, the plates perform their usual function of holding the food as it is consumed.

Important desired attributes of disposable plate lids include low cost, structural simplicity, ease of application and removal, and security of attachment to the plates they cover. Plate lids and equivalent devices heretofore available, however, have generally been less than satisfactory in one or more of these respects. In particular, they tend to be very vulnerable to accidental dislodgment, with resultant premature exposure of the covered food and inconvenience to the user.

SUMMARY OF THE INVENTION

In a first aspect, the present invention broadly contemplates the provision of a container for food or the like, comprising a disposable plate having opposed convexly arcuate edge portions, and a unitary disposable lid of foldable, resilient sheet material for overlying the plate and engaging the edge portions thereof, formed from an initially flat sheet blank and including a flat central panel and a skirt which is manipulable between a first, unstressed position and a second, open position wherein the skirt flares obliquely outwardly and downwardly from the central panel for surrounding the periphery of the plate. The skirt comprises four side panels integral with and disposed in succession around the periphery of the central panel, and arranged in two opposed pairs; each of the side panels has an outer edge, opposed cut end edges, and opposed foldable end flaps, the end flaps of each side panel of one of the two pairs being respectively overlappingly adhered to adjacent end flaps of the other pair of side panels.

As a particular feature of the invention, the side panels of a first one of the two pairs respectively have slots for receiving the aforementioned plate edge portions and are disposed, in the unstressed position, with their respective outer edges below the central panel and spaced inwardly from their locations in the open position, while the side panels of the second of the two pairs are disposed, in the unstressed position, with their respective outer edges spaced outwardly from their locations in the open position. Thus, upon outward bending of the first pair of side panels, i.e. to open the skirt, the side panels of the second pair are bent inwardly toward each other and, in resisting such bending, exert on the first pair of panels a force for urging them into secure engagement with the plate edge so that the aforementioned plate edge portions are received and retained in the slots.

The terms "inwardly" and "outwardly," and equivalent expressions, as used herein, refer to directions respectively toward and away from the geometric center of the lid when the skirt is in open position. Terms such as "upper," "lower," "below," etc., are used with reference to the customary orientation of the lid when covering a food-containing plate. The characterization of the first position of the skirt as "unstressed" refers to the absence of functionally significant resilient bias forces, resulting from stressing (bending) of the second pair of side panels, when the skirt is in such position.

Conveniently, and preferably, the sheet material of the lid is paperboard. The plate may be of generally conventional character, e.g. fabricated of a material such as paperboard or foam plastic, and, as is also conventional, may be a circular (or elongated) plate or tray having a central dished portion and an elevated rim. In an alternative embodiment of the container of the invention, the plate is of planar, circular configuration (again, e.g., fabricated of paperboard) and the skirt is dimensioned, when in open position overlying and engaging the edge portions of the plate, to enclose with clearance an article of food such as a pizza or the like lying on the plate.

In a second aspect, the invention contemplates the provision of a lid as described above, for covering a disposable plate having opposed convexly arcuate edge portions.

Advantageously, in the lid of the invention, the central panel is rectangular and the four side panels respectively extend along the four sides of the central panel, with the cut end edges of each side panel extending outwardly from adjacent corners of the central panel; also, each side panel has a flat midsection between its opposed end flaps, the plate-edge-receiving slots being formed in the midsections of the aforementioned first pair of side panels. As further and particularly advantageous features of the invention, in especially preferred embodiments, the lid is an outfold tray wherein, in the unstressed position of the skirt, the first-pair side panels are folded inwardly under the central panel, their end flaps being coplanar with their midsections, while the midsections of the second pair of side panels are maintained in unfolded, coplanar relation to the central panel, and the end flaps of the second pair of side panels are folded inwardly to overlap the end flaps of the first-pair side panels and are adhered thereto. Preferably, the central and side panels and the end flaps are defined by score lines impressed in the blank from which the lid is made, the described folds being effected along appropriate ones of these score lines while others of the score lines remain unbent.

Such a lid is very preferably produced, in accordance with the invention, from an initially flat sheet blank by the steps of folding the first-pair side panels inwardly under the central panel, folding the end flaps of the second-pair side panels inwardly to overlap the end flaps of the first-pair side panels, and adhering the overlapped end flaps together while maintaining the end flaps of the first-pair side panels unfolded relative to the midsections thereof and while maintaining the midsections of the second-pair side panels unfolded relative to the central panel.

As still another beneficial feature of the invention, the slots in the lid side panels extend horizontally and have generally serrated lower edges to contribute to the desired secure engagement of the lid with the plate edges. Preferably, in a lid for use with a circular plate, such slots are provided in the second (initially unfolded) pair of side panels as well as in the first (inwardly folded) pair.

Especially as embodied in an outfold tray, the lid of the invention is both readily fabricated and easily applied to (and removed from) a paper or other disposable plate. It is inexpensive, owing to its simple construction and the low material cost of paperboard, which has properties of foldability and resilience highly suitable for the lid structure. It is also easily stored, occupying minimal space, since in the unstressed position of the skirt, the lid is folded flat. Most important, when the skirt is opened and fitted over a plate with portions of the plate rim or edge received in the side panel slots, the skirt grips the plate edge securely (to hold the lid against accidental dislodgment), as a result of the resistance to bending exhibited by previously unbent portions of a material such as paperboard, that resistance being transmitted to the first-pair side panels as a force urging the latter panels resiliently inwardly against the plate edge portions they engage.

Further features and advantages of the invention will be apparent from the detailed description hereinbelow set forth, together with the accompanying drawings.

DETAILED DESCRIPTION

Figure 1:
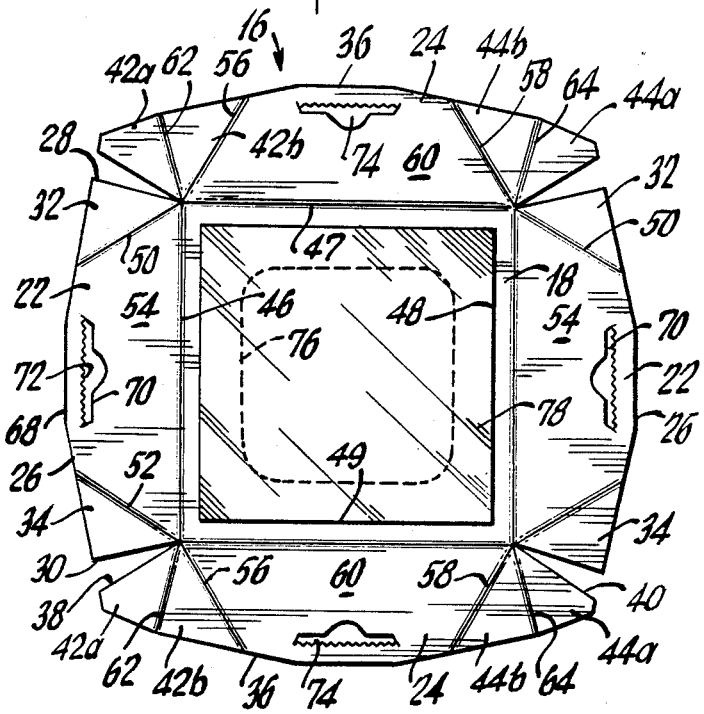
FIG. 1 is a bottom plan view of a cut and scored but unfolded blank for a disposable plate lid embodying the present invention in a particular form.

For purposes of illustration, with reference to FIGS. 1–4, the invention will be described as embodied in a disposable food container 10 comprising a paperboard plate 11 and a lid 12 also fabricated of paperboard. The plate 11, as shown in FIGS. 3 and 4, has a dished central portion 14 and an upstanding rim 15 with a circular periphery and a curled edge 15*a*. Every portion of the plate edge is, therefore, convexly arcuate. The plate may be entirely conventional in manufacture, structure, materials, and function, and accordingly need not be further described.

Figure 2:
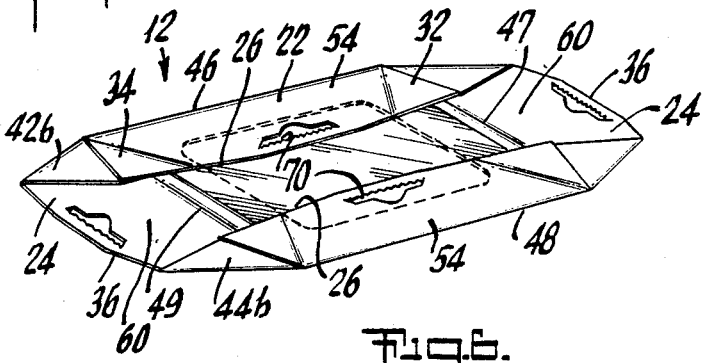
FIG. 2 is a perspective bottom view of a lid, in folded condition and glued, produced from the blank of FIG. 1.
Figure 3:
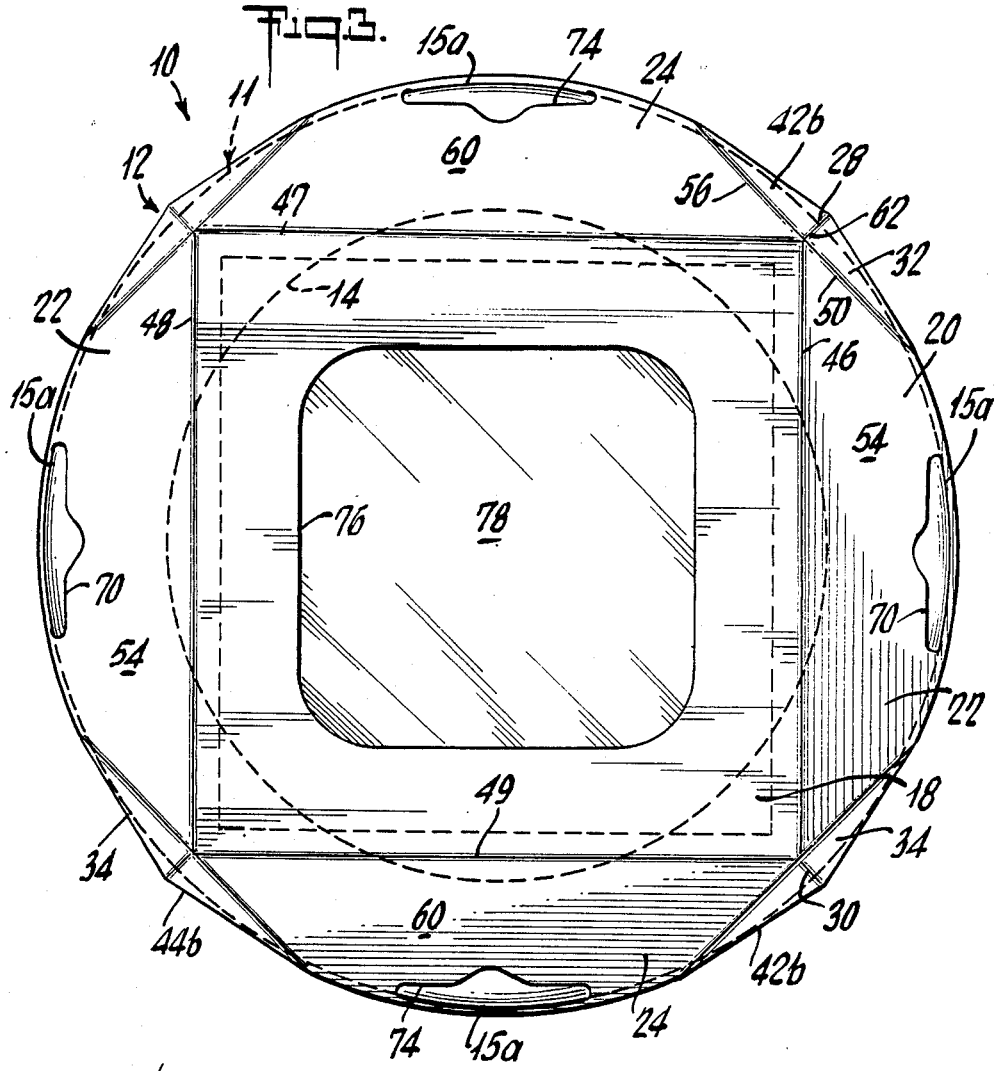
FIG. 3 is a somewhat enlarged top plan view of an assembled container embodying the invention and comprising the lid of FIG. 2 mounted on a disposable plate.
Figure 4:
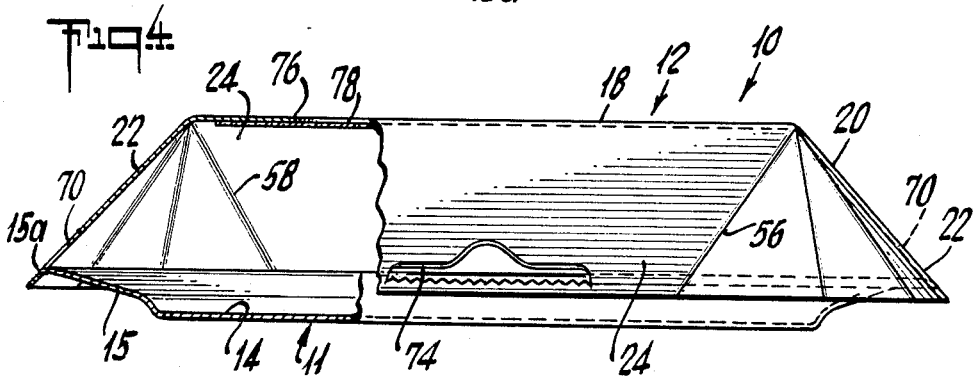
FIG. 4 is a side elevational view, partly in section, of the container of FIG. 3.

The lid 12 of the invention, in the embodiment shown in FIGS. 1–4, is a unitary article of foldable, resilient paperboard formed from an initially flat sheet paperboard blank 16 (FIG. 1). It includes a flat central panel 18 of rectangular shape (square, in FIGS. 1–4) and a skirt 20 which is manipulable between a first, unstressed, folded position (FIG. 2) and a second, open position (FIGS. 3 and 4) in which the skirt flares obliquely downwardly and outwardly from the central panel 18 for surrounding the periphery of the plate 11. This skirt comprises a first pair of side panels 22 and a second pair of side panels 24, integral with and extending along the sides of the central panel 18, the side panels of each pair being opposed, i.e. respectively disposed on two opposite sides of the central panel.

Each of the first-pair side panels 22 has an outer edge 26, two opposed cut end edges 28 and 30, and two opposed foldable end flaps 32 and 34. Similarly, each of the second-pair side panels has an outer edge 36, two opposed cut end edges 38 and 40, and two opposed foldable end flaps 42 and 44. In the completed lid (FIGS. 2–4), the two end flaps 32 and 34 of one of the panels 22 are respectively overlappingly adhered to the adjacent end flaps 42 of both of the panels 24, while the two end flaps 32 and 34 of the other panel 22 are respectively overlappingly adhered to the adjacent end flaps 44 of both of the panels 24.

In the initially flat blank 16 (FIG. 1), the lid panels and end flaps are defined by rectilinear crease or score lines impressed (e.g. in conventional manner) on the paperboard blank to serve as fold or bend lines. Specifically, the central panel 18 is defined by four major impressed score lines 46, 47, 48 and 49 extending, along the sides of the central panel, between that panel and the four side panels 22, 24, 22, and 24, respectively; each of the panels 22 is divided, by two primary transverse impressed score lines 50 and 52, into a flat midsection 54 and the aforementioned two end flaps 32 and 34; and each of the panels 24 is likewise divided, by two primary transverse score lines 56 and 58, into a flat midsection 60 and the two end flaps 42 and 44. In addition, the end flaps 42 and 44 of the panels 24 are subdivided into two portions each by secondary impressed score lines 62 (on flaps 42) and 64 (on flaps 44).

The cut end edges 28 and 30 of each first pair side panel 22 diverge outwardly (relative to each other) from adjacent corners of the central panel 18, while the primary transverse score lines 50 and 52 on the same panel 22 converge outwardly from the latter corners. In consequence, each of the end flaps 32 (defined between edge 28 and line 50) and 34 (defined between edge 30 and line 52) is wedge-shaped, having its apex at a corner of the central panel, with an outwardly-opening apical angle of about 45°. The outer edge 26 of each panel 22 is formed as a succession of rectilinear portions of progressively differing angular orientation that meet, and form obtuse salient angles 66 and 68, at points intermediate the panel end edges.

The cut end edges 38 and 40 of each second-pair side panel 24 diverge outwardly from adjacent corners of the central panel 18, and the primary transverse score lines 56 and 58 on the same panel 24 converge outwardly from the latter corners, forming, however, outwardly-opening apical angles of about 90° with the end edges 38 and 40 respectively. The secondary transverse score lines 62 and 64, also diverging outwardly from the same corners (and bisecting the latter angles), respectively divide the flaps 42 and 44 into two wedge-shaped segments (42*a*, 42*b* and 44*a*, 44*b*) each having an apex at a corner of the central panel and an outwardly-opening apical angle of about 45°. The outer edge 36 of each panel 24 is constituted of successive rectilinear portions progressively differing in angular orientation and meeting to form obtuse salient angles at points intermediate the panel end edges.

It will be seen that each side of the central panel 18 is joined to (and integral with) the midsection of one of the side panels along its entire length, while at each corner of the central panel are disposed a pair of side panel end flaps, of which one (an end flap of a first-pair side panel 22) is a single wedge-shaped segment with a 45° apical angle and the other (an end flap of a second-pair side panel 24) is divided into two wedge-shaped segments each having a 45° apical angle, one of the latter two segments being bounded by a cut end edge of the second-pair side panel of which it is a part. The edge-bounded segments are shown at 42*a* and 44*a*. In the completed lid (FIG. 2), each end flap 32 or 34 of a first-pair side panel 22 overlaps, and is adhered to, only the edge-bounded segment (42*a* or 44*a*) of the adjacent end flap of a second-pair side panel. Thus, at each central-panel corner in the completed lid, there are three transverse score lines radiating outwardly from the corner (e.g. lines 50, 62, and 56, at the upper right-hand corner in FIG. 3) along which the skirt 20 is or may be bent when it is opened to the position shown in FIGS. 3 and 4. The opened skirt, though constituted of only four side panels, therefore has twelve successive planar segments (four side panel midsections, separated by pairs of wedge-shaped end flap segments) capable of assuming progressively different angular orientations around an inscribed circle, viz. the plate rim. This feature of construction, together with the illustrated configuration of the side panel outer edges, provides desired conformity of the opened skirt to the rim of the plate it surrounds.

Each of the first-pair side panel midsections 54 has a slot 70 formed therein for receiving an edge portion of the plate 11. Each slot is oriented to extend horizontally in the opened skirt (FIGS. 3 and 4) and is centered between the ends of the side panel in which it is formed, so that the two slots 70 respectively provided in the two side panels 22 are diametrically opposed. The lower horizontal edge 72 of each slot (referring to the orientation of the slots in the opened skirt) is serrated (e.g. formed with wavy or sawtooth projections) to hook under the curled plate edge 15*a* and thereby to contribute to the desired secure engagement of the lid with the plate. In the embodiment shown in FIGS. 1–4, two more plate edge receiving slots 74 (identical to the slots 70) are formed in the midsections of the second-pair side panels 24, again at diametrically opposed locations centered in the side panel midsections.

To enable viewing of the contents of a plate covered by the lid, the central panel 18 may be provided with a cutout viewing aperture 76 covered by a sheet 78 of flexible transparent material adhered around its edges to the lower major surface of the central panel outwardly of the periphery of the aperture 76.

In the production of the lid 12 in accordance with the invention, the blank 16 is initially cut from a flat sheet of paperboard, to form the outer and side end edges of the side panels. The slots 70 and 74 and the aperture 76 are formed in the blank by cutting or punching; the major score lines and primary and secondary transverse score lines are impressed in the blank, defining the central panel and the end flaps and flap segments of the side panels, and the transparent sheet 78 is adhered to the central panel. At this point, the blank has the appearance illustrated in FIG. 1.

Next, the end flaps 42 and 44 of the two second-pair side panels 24 are folded inwardly, respectively on the primary transverse score lines 56 and 58, until they lie flat against the lower major surfaces of the panel midsections 60, with their outer or edge-bounded wedge-shaped segments projecting across corner portions of the lower major surface of the central panel 18. The two side panels 22 of the first pair are folded inwardly, under the central panel, respectively along major score lines 46 and 48, until they lie flat against the lower major surface of the central panel, with their end flaps respectively overlapping the edge-bounded segments of the second-pair side panel end flaps, as shown in FIG. 2, wherein (as in FIG. 1) the visible surfaces of the central panel and of the second-pair side panel midsections are the lower major surfaces thereof. The end flaps of the first-pair side panels are then respectively adhered (e.g. by gluing) to the thus-overlapped segments of the second-pair side panel end flaps, completing the production of the folded lid of FIG. 2.

In the described procedure, folds are made only on the major score lines and on the primary transverse score lines 56 and 58; all the other score lines are maintained in their initial unfolded (and consequently unstressed) condition. Thus, while the first-pair side panels 22 are folded inwardly under the central panel 18, their end flaps remain unfolded relative to (and coplanar with) their midsections; and while the end flaps of the second pair side panels 24 are folded inwardly so as to be overlapped by and adhered to the first-pair side panel end flaps, the midsections 60 of the panels 24 remain unfolded relative to (and coplanar with) the central panel 18. Also, the secondary transverse score lines dividing the end flaps of the second pair of side panels remain in unfolded condition.

The skirt of the lid as thus produced by the foregoing cutting, folding and gluing steps is in its first, unstressed position, shown in FIG. 2, wherein the outer edges 26 of the first-pair side panels 22 are below the central panel 18 and spaced inwardly from their locations in the open position of the skirt, and the outer edges 36 of the second-pair side panels 24 are spaced outwardly from their locations in the open position of the skirt. The lid 12 is accordingly constituted as an outfold tray; i.e., for manipulation of the skirt to open position, the two first-pair side panels are unfolded outwardly. The as-produced lid illustrated in FIG. 2 is in a flat-folded condition occupying minimal space, as is convenient for storage or shipment.

To apply the lid 12 to a plate 11, the skirt 20 is manipulated from the first position of FIG. 2 to the open position of FIGS. 3 and 4 by manually bending the two first-pair side panels 22 outwardly until their outer edges are spaced sufficiently far apart to fit over diametrically opposed portions of the plate edge 15*a*. Since the first and second pairs of side panels are interconnected by their adhered end flaps, the outward unfolding or bending of the first-pair side panels forces the second-pair side panel midsections 60 to bend downwardly and inwardly, respectively along the previously unfolded major score lines 47 and 49, and also bends the end flaps inwardly at the previously unfolded transverse score lines 50, 52, 62, and 64. Such bending, along score lines not previously folded, is resisted by the resilient and previously unstressed portions of the paperboard at these score lines; the resultant restoring forces urge the second-pair side panels back outwardly and act through the adhered end flaps to urge or bias the first-pair side panels back inwardly.

The opened lid is moved downwardly to cover the plate 11, with the skirt 20 surrounding and extending slightly below the plate rim edge 15*a*, until edge portions of the plate come into register with the slots 70 and 74. When the side panels 22*a* and 22*b* l; are now released, the above-described resilient bias forces urge the latter side panels inwardly against the plate rim, so that edge portions of the plate are received in the opposed slots 70 and engaged by the serrations of slot edges 72, which hook under the curled edge 15*a*. The serrations of the slots 74 may also be hooked under portions of the curled rim edge of the plate to assist in holding the lid on the plate.

The assembled plate and lid together constitute a container for food carried by the plate, the skirt 20 holding the central panel 18 spaced above the plate and thereby providing a substantially fully enclosed chamber. The lid is securely locked on the plate by the cooperation of the aforementioned resilient bias forces and the engagement of the slot serrations under the curled plate rim; hence, it is not vulnerable to accidental dislodgment. Nevertheless, owing to the flexibility of the paperboard of which it is made, it is readily manually removed for access to the contents of the plate.

Figure 5:
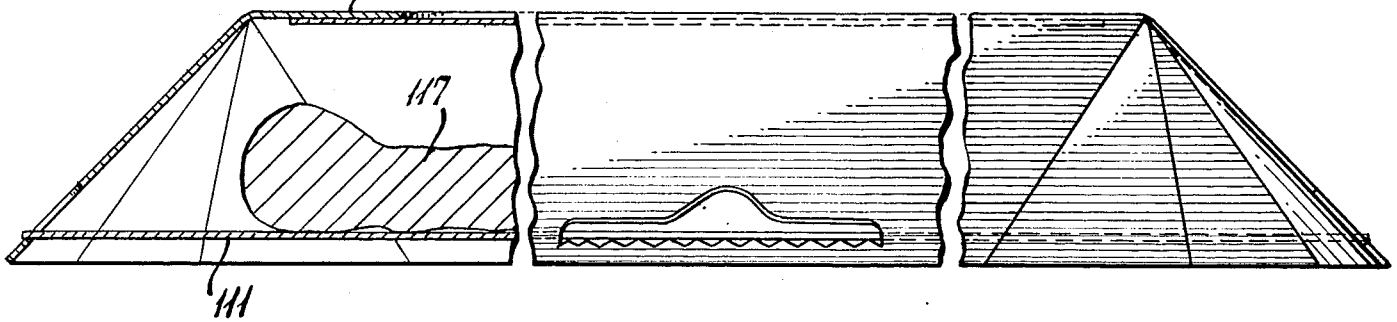
FIG. 5 is a fragmentary view, similar to FIG. 4, of another embodiment of the container of the invention.

In the embodiment shown in FIG. 5, the dished plate 11 is replaced by a flat paperboard disc 111 for supporting a fast-food article such as a pizza 117 or the like, the lid 112 is dimensioned and proportioned to enclose with clearance such an article on a flat rather than dished plate. The lid 112 is in other respects essentially identical to the lid 12 of FIGS. 1–4.

Figure 6:
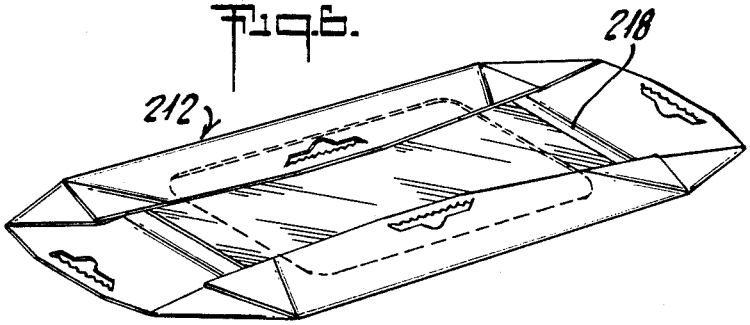
FIG. 6 is a view similar to FIG. 2 of a further embodiment of the lid of the invention.

The lid 212 illustrated in FIG. 6 is again essentially structurally and functionally identical to the lid 12 of FIGS. 1–12 but is shaped to cover an elongated plate or tray. Accordingly, the central panel 218 is of elongated rectangular rather than square shape.

It is to be understood that the invention is not limited to the features and embodiments hereinabove specifically set forth, but may be carried out in other ways without departure from its spirit.

What is claimed is:

1. A container for food or the like, comprising (a) a disposable plate having opposed convexly arcuate edge portions, and (b) a unitary lid of foldable, resilient sheet material for overlying the plate and engaging the edge portions thereof, formed from an initially flat sheet blank and including a flat central panel and a skirt which is manipulable between a first, unstressed position and a second, open position wherein the skirt flares obliquely outwardly and downwardly from said central panel for surrounding the periphery of the plate, said skirt comprising four side panels integral with and disposed in succession around the periphery of the central panel, said side panels being arranged in two opposed pairs, each of said side panels having an outer edge, opposed cut end edges, and opposed foldable end flaps, the end flaps of each side panel of one of said pairs being respectively overlappingly adhered to adjacent end flaps of the side panels of the other of said pairs, the side panels of said one pair respectively having slots for receiving said plate edge portions and being disposed, in the unstressed position, with their respective outer edges below the central panel and spaced inwardly from their locations in the open position, and the side panels of said other pair being disposed, in the unstressed position, with their respective outer edges spaced outwardly from their locations in the open position, such that upon outward bending of said one pair of side panels, the side panels of said other pair are bent inwardly toward each other and, in resisting such bending, exert on said one pair of panels a force for urging them into secure engagement with the plate edge portions;

(c) said plate being of planar, circular configuration and said skirt being dimensioned, when in said second position overlying and engaging the edge portions of the plate, to enclose with clearance an article of food such as a pizza or the like lying on the plate.

* * * * *